US005209358A

United States Patent [19]

Simard

[11] Patent Number: 5,209,358

[45] Date of Patent: May 11, 1993

[54] BOTTLE DISPENSING RACK FOR BAR

[75] Inventor: Gilbert Simard, Beauport, Canada

[73] Assignee: Azbar Inc., Canada

[21] Appl. No.: 894,267

[22] Filed: Jun. 8, 1992

[51] Int. Cl.[5] ..... A47F 7/00

[52] U.S. Cl. ..... 211/74; 211/94; 221/7

[58] Field of Search ..... 211/74, 59.2, 94, 162; 221/2, 7

[56] References Cited

U.S. PATENT DOCUMENTS

| | | | |
|---|---|---|---|
| 2,919,814 | 1/1960 | Berkowitz | 211/74 |
| 3,753,507 | 8/1973 | James et al. | 221/7 X |
| 3,920,149 | 11/1975 | Fortino et al. . | |
| 4,022,363 | 5/1977 | Eliassen | 211/74 X |
| 4,162,028 | 7/1979 | Reichenberger . | |
| 4,237,536 | 12/1980 | Enelow et al. . | |
| 4,401,221 | 8/1983 | Suttler | 211/74 X |

FOREIGN PATENT DOCUMENTS

| | | | |
|---|---|---|---|
| 259169 | 2/1965 | Australia | 211/74 |
| 2116763 | 9/1983 | United Kingdom . | |

*Primary Examiner*—Robert W. Gibson, Jr.
*Attorney, Agent, or Firm*—Quarles & Brady

[57] ABSTRACT

The rack comprises a pair of rails for slidingly holding a neck of a bottle and a turnstile at the entrance to the rails. A control signal is generated each time the turnstile is moved as a bottle is placed onto the rack or removed from the rack. The rack is easily adapted and installed into existing refrigeration units, is tamper proof and inexpensive to manufacture.

3 Claims, 1 Drawing Sheet

BOTTLE DISPENSING RACK FOR BAR

Field of the Invention

The present invention relates to a system for dispensing bottles in a bar.

Background of the Invention

Bottle dispensing racks for use in bar control systems are known in the art. UK patent 2,116,763 describes a bar system in which the removal and stocking of bottles on a rack are detected for monitoring by the bar control system.

Such racks are not easily installed into existing refrigeration units, and are not always tamper proof.

Summary of the Invention

It is an object of the invention to provide a bottle dispensing rack for use in a bar control system which is easily adapted and installed into existing refrigeration units, is tamper proof and is inexpensive to manufacture.

According to the invention, there is provided a bottle dispenser rack for use in a bar system, comprising: a pair of rails on which an annular lip on a neck of the bottle can slide; turnstile means mounted at an entrance end of the rails, the turnstile means being rotated by one position in a first direction as the bottle is removed from the rails and in a second direction as the bottle is moved onto the rails past the turnstiles; and signal means for generating a first signal each time the turnstile means are rotated by the one position in the first direction. In this way, each time a bottle is removed from the rails, the first signal is generated.

Preferably, the signal means generate a second signal each time the turnstile means are rotated by the one position in the second direction, whereby each time a bottle is put on the rails, the second signal is generated.

Preferably, the signal means comprise a three position lever switch resiliently biased in a middle position and an off-state, and tab means provided on the turnstile means for engaging the lever switch, the switch being moved into a first state and back to the off-state as the turnstile means are moved in the first direction and into a second state and back to the off-state as the turnstile means are moved in the second direction.

DETAILED DESCRIPTION OF THE PREFERRED EMBODIMENT

Figure 1:
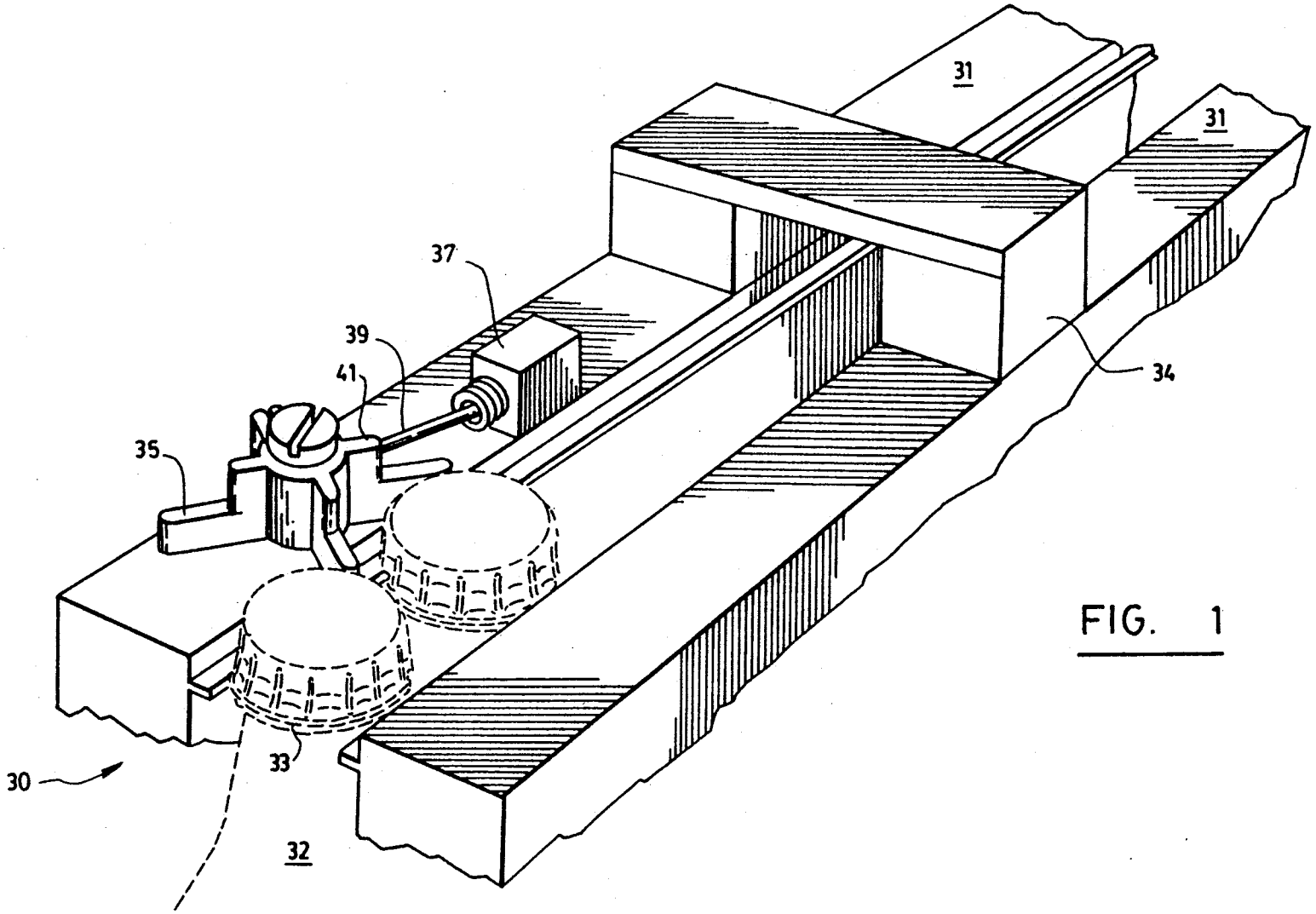
FIG. 1 is a perspective view of the bottle dispenser according to the preferred embodiment.

Rack (30) comprises a pair of rails (31) which have on the inside a blade for supporting a ring-like protrusion (33) of bottle (32). A bracket (34) is used to mount the rack (30) to an underside of a shelf of a refrigeration unit not shown. The space between rails (31) and the clearance between rails (31) and the refrigerator shelf are made adjustable by bracket (34), such that a bottle (32) of a given size and shape (determined by the brand) can be slid along the rails (31).

Turnstile means (35) are mounted on one rail (35) as shown such that each time the bottle (32) is slid onto rails (31), the means (35) are rotated by one position. With each rotation, a cam (41) attached to the turnstile (35) moves a lever (39) of switch (37) in one direction. Each time a bottle (32) is removed from rack (30), the turnstile (35) rotates in an opposite direction one position, and the cam (41) acts on lever (39) to push switch (37) in the opposite direction. As the switch (37) is activated and released each time the turnstile (35) rotates by one position, signals are generated to indicate whether a bottle (32) has been placed on or removed from the rack (30).

Although not shown in the Figure, rack (30) is to be provided with a stop at its far end to prevent removal of bottles therefrom. This stop is usually provided by the rear wall of the refrigerator unit.

The turnstile means (35) are shown to be mounted on one of the rails (31), however, it is possible to mount means (35) elsewhere, such as centrally between the rails (31) rotating about a horizontal axis, so long as the means (35) are rotated as the bottle is slid onto and off the rails (31).

What is claimed is:

1. A bottle dispenser rack for use in a bar system, comprising:

a pair of rails on which an annular lip on a neck of the bottle can slide;

turnstile means mounted at an entrance end of the rails, the turnstile means being rotated by one position in a first direction as the bottle is removed from the rails and in a second direction as the bottle is moved onto the rails past the turnstiles; and signal means for generating a first signal each time the turnstile means are rotated by said one position in said first direction, whereby each time a bottle is removed from the rails, the first signal is generated.

2. Dispenser rack as defined in claim 1, wherein the signal means generate a second signal each time the turnstile means are rotated by said one position in said second direction, whereby each time a bottle is put on the rails, the second signal is generated.

3. Dispenser rack as defined in claim 2, wherein the signal means comprise a three position lever switch resiliently biased in a middle position and an off-state, and tab means provided on the turnstile means for engaging the lever switch, said switch being moved into a first state and back to said off-state as the turnstile means are moved in said first direction and into a second state and back to said off-state as the turnstile means are moved in said second direction.

* * * * *